US010137463B2

(12) United States Patent
Collmer

(10) Patent No.: US 10,137,463 B2
(45) Date of Patent: Nov. 27, 2018

(54) COATING AGENT LINE WITH GROUNDING ELEMENT

(71) Applicant: Durr Systems GmbH, Bietigheim-Bissingen (DE)

(72) Inventor: Andreas Collmer, Vaihingen/Enz (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 400 days.

(21) Appl. No.: 14/373,979

(22) PCT Filed: Jan. 25, 2013

(86) PCT No.: PCT/EP2013/000226
§ 371 (c)(1),
(2) Date: Jul. 23, 2014

(87) PCT Pub. No.: WO2013/110466
PCT Pub. Date: Aug. 1, 2013

(65) Prior Publication Data

US 2015/0017340 A1 Jan. 15, 2015

(30) Foreign Application Priority Data

Jan. 27, 2012 (DE) ..... 10 2012 001 563

(51) Int. Cl.
*B05B 5/16* (2006.01)
*B05D 1/04* (2006.01)
(Continued)

(52) U.S. Cl.
CPC ..... *B05B 5/1616* (2013.01); *B05B 5/10* (2013.01); *B05B 5/1608* (2013.01); *B05B 15/00* (2013.01);
(Continued)

(58) Field of Classification Search
CPC ..... B05B 5/1608; B05B 5/10; B05B 15/1214; B05D 1/04
See application file for complete search history.

(56) References Cited

U.S. PATENT DOCUMENTS 3,031,145 A 4/1962 Croskey
3,591,080 A * 7/1971 Kock ..... B05B 5/03 239/705
(Continued)

FOREIGN PATENT DOCUMENTS

CA 1039125 9/1978
CN 101522313 A 9/2009
(Continued)

OTHER PUBLICATIONS

International Search Report dated Apr. 25, 2013 (2 pages).
PCT Written Opinion (6 pages).

*Primary Examiner* — Karl Kurple
(74) *Attorney, Agent, or Firm* — Bejin Bieneman PLC

(57) ABSTRACT

The invention relates to a painting booth for coating components, particularly for painting motor vehicle body components, with a booth wall (10) and a coating agent line (1), which runs from the exterior of the booth through the booth wall (10) into the interior of the booth. The invention proposes that the coating agent line (1) has an electrically conductive and axially running potential-compensating element (15) inside the line for electrically connecting the coating agent inside the line to an electrical reference potential, said potential-compensating element (15) extending from the exterior of the booth through the booth wall (10), so that the free end of the potential-compensating element (15) is inside the booth.

14 Claims, 2 Drawing Sheets

Figure 1:
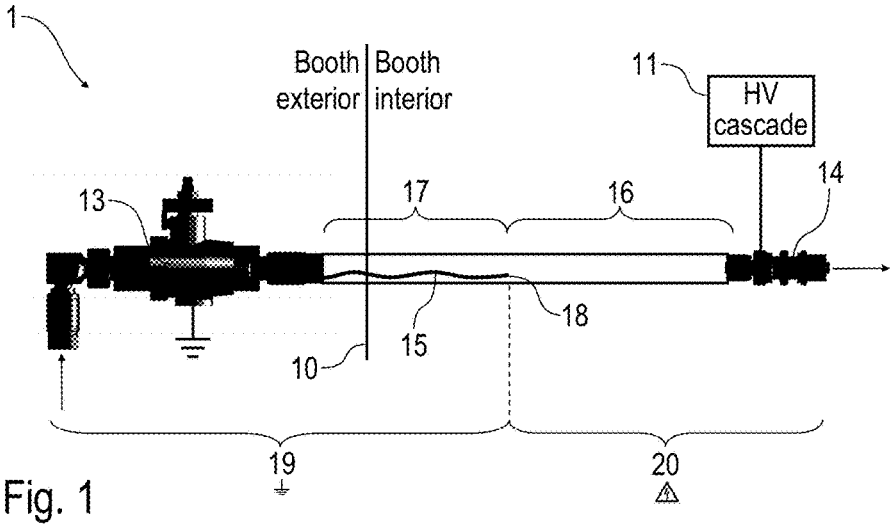

(51) Int. Cl.

| | |
|---|---|
| ***B05B 5/10*** | (2006.01) |
| ***B05B 15/00*** | (2018.01) |
| ***B05B 16/40*** | (2018.01) |
| ***B05B 16/00*** | (2018.01) |
| *B05C 11/10* | (2006.01) |

(52) U.S. Cl.
CPC ..... *B05B 16/00* (2018.02); *B05B 16/40* (2018.02); *B05D 1/04* (2013.01); *B05C 11/10* (2013.01); *Y10S 901/43* (2013.01)

(56) References Cited

U.S. PATENT DOCUMENTS

| | | | | | |
|---|---|---|---|---|---|
| 3,645,447 | A | | 2/1972 | Cowan | |
| 3,735,925 | A | * | 5/1973 | Benedek | B05B 5/03 239/704 |
| 3,864,603 | A | * | 2/1975 | Kozinski | B05B 5/1608 118/707 |
| 3,893,620 | A | * | 7/1975 | Rokadia | B05B 5/165 118/629 |
| 3,934,055 | A | * | 1/1976 | Tamny | B05B 5/1616 239/3 |
| 4,209,134 | A | * | 6/1980 | Coffee | B05B 5/1691 174/50.52 |
| 4,219,864 | A | * | 8/1980 | Grunenfelder | B05B 5/025 239/704 |
| 4,221,339 | A | * | 9/1980 | Yoshikawa | B05B 5/03 239/400 |
| 4,232,055 | A | * | 11/1980 | Shaffer | B05B 5/1608 427/477 |
| 4,313,475 | A | * | 2/1982 | Wiggins | B05B 5/1625 118/506 |
| 4,343,828 | A | * | 8/1982 | Smead | B05B 5/004 118/621 |
| 4,630,567 | A | * | 12/1986 | Bambousek | B05B 13/0431 118/323 |
| 4,656,051 | A | * | 4/1987 | Wojcik | B05B 13/0221 118/630 |
| 4,675,203 | A | * | 6/1987 | Scarbrough | B05B 5/08 118/326 |
| 5,737,174 | A | * | 4/1998 | Konieczynski | B05B 5/1625 218/11 |
| 5,765,761 | A | * | 6/1998 | Law | B05B 5/03 239/690.1 |
| 6,021,965 | A | * | 2/2000 | Hartle | B05B 5/1608 138/120 |
| 6,032,871 | A | * | 3/2000 | Borner | B05B 5/003 118/629 |
| 6,138,922 | A | * | 10/2000 | Hartman | B05B 5/03 239/3 |
| 6,641,667 | B2 | * | 11/2003 | Ochiai | B05B 7/0408 118/321 |
| 7,150,412 | B2 | * | 12/2006 | Wang | B05B 5/025 239/102.1 |
| 7,455,249 | B2 | * | 11/2008 | Cedoz | B05B 5/1616 118/621 |
| 7,622,001 | B2 | * | 11/2009 | Inada | B25J 19/0029 118/300 |
| 7,845,307 | B2 | * | 12/2010 | Janssen | B05B 1/12 118/620 |
| 8,453,597 | B2 | | 6/2013 | Ansorge et al. | |
| 2004/0238200 | A1 | * | 12/2004 | Tanaka | H01R 13/5216 174/74 R |
| 2005/0040262 | A1 | * | 2/2005 | Nagai | B05B 5/0407 239/690 |
| 2007/0235571 | A1 | * | 10/2007 | Cedoz | B05B 5/1616 239/690 |
| 2010/0047465 | A1 | | 2/2010 | Ansorge et al. | |
| 2011/0221100 | A1 | * | 9/2011 | Wesselky | B05B 3/1092 264/401 |

FOREIGN PATENT DOCUMENTS

| | | | |
|---|---|---|---|
| DE | 973208 | | 12/1959 |
| DE | 1246478 | | 8/1967 |
| DE | 1965509 | | 7/1970 |
| DE | 2455161 | | 5/1975 |
| DE | 3526013 | C1 | 10/1986 |
| DE | 10313063 | A1 | 4/2004 |
| EP | 1500435 | A2 | 1/2005 |
| GB | 697701 | | 9/1953 |
| RU | 2128088 | C1 | 3/1999 |
| RU | 2388550 | C1 | 5/2010 |
| RU | 2402718 | C2 | 10/2010 |
| WO | 2008019736 | A1 | 2/2008 |

* cited by examiner

COATING AGENT LINE WITH GROUNDING ELEMENT

CROSS-REFERENCE TO RELATED APPLICATION

This application claims priority to and is a National Phase of International Application No. PCT/EP2013/000226, filed on Jan. 25, 2013, which claims priority to German Application No. 10 2012 001 563.1, filed on Jan. 27, 2012, which applications are each hereby incorporated by reference in their entireties.

BACKGROUND AND FIELD

Disclosed herein is a painting booth with a coating agent line for conveying a coating agent, in particular in a painting installation, with electrostatic coating agent charging. Further disclosed is a corresponding manufacturing method for a coating agent line of this type.

Modern painting installations to paint motor vehicle body components usually include electrostatic coating agent charging which electrostatically charges paint to be applied so that the paint better adheres to a motor vehicle body component to be painted, which is therefore electrically grounded.

One possibility for electrostatic coating agent charging of this type is so-called direct charging, wherein the paint to be applied itself is electrostatically charged and therefore is at a high electric potential even in the coating agent lines within an applicator (e.g. an atomiser, etc.).

The actual painting in the direct charging example is usually performed by a painting robot within a painting booth, whereby the painting robot is supplied with the paint to be applied through coating agent lines. These coating agent lines run from a paint supply located outside the painting booth to an atomiser on the painting robot, whereby the painting robot additionally carries a high voltage cascade in order to electrostatically charge the paint to be applied. The high voltage necessary for the electrostatic coating agent charging inside the painting booth is a source of danger so that a fire protection device (e.g. sprinkler system, $CO_2$ extinguishing system, fire protection sensor) is installed inside the painting booth which can react in the case of fire to prevent the high voltage of the electrostatic coating agent charging from causing a fire or other damage.

In addition, these conventional painting installations usually have an grounding interface which is arranged inside the painting booth or at least at the booth wall and electrically grounds the coating agent lines here. This prevents any high voltage potential along the coating agent line inside the painting booth from escaping to the outside, which could lead to a fire or other incident. This is made even more important because the fire protection device is arranged inside the painting booth and can only react to high voltage related incidents which occur inside the painting booth. The above-mentioned conventional grounding interfaces for coating agent lines usually have so-called grounding bulkhead plates which are associated with different disadvantages.

Firstly, grounding interfaces of this type require a high number of hose screw connections via which the electrostatically charged coating agent has a connection to the respective grounding connection, whereby up to 56 hose screw connections may be necessary for every painting robot.

Secondly, additional components are required for the mechanical fixing of the conventional grounding interfaces, such as mounting plates, bulkhead plates, bulkhead screwed connections, strain relief, covers, sheeting, etc.

Further, with respect to the painting robots inside a painting booth, different installation possibilities may exist (e.g. top, bottom, directly at the booth wall or at a distance to the booth wall) in accordance with the respective area of use so that the grounding interfaces must also be adjusted accordingly, which makes a standardisation of the grounding interfaces difficult or even impossible. In practice, additional adjustment structures may frequently be necessary in-situ when assembling a painting installation, which makes assembly difficult.

Furthermore, with respect to the state of the art, patent application EP 1 500 435 A2 discloses a piggable coating agent hose, whereby the inner surfaces of the coating agent hose can be electrically conductive. Here, however, the coating agent hose is electrically conductive over its entire length, which is not desired in the inventive coating agent line because the electrical grounding of the coating agent hose is to act only on the grounding side and not on the high voltage side. This conventional, electrically conductive coating agent hose is therefore not suitable in the presently disclosed context.

A painting booth is known from DE 35 26 013 C1 in which the high voltage generator is arranged outside the painting booth.

Finally, reference is to be made to DE 24 55 161 OS, DE 1 965 509 OS, DE 1 246 478 AS and DE 973 208 PS with respect to the state of art.

DESCRIPTION

Disclosed herein is improved electrical grounding of a coating agent line in a painting booth.

An entire painting booth for coating components, particularly for painting motor vehicle body components, has a coating agent line that supplies an application device (e.g., rotary atomiser) located inside the painting booth with the coating agent to be applied.

The coating agent line is led through a booth wall of the painting booth from the booth exterior to the booth interior, whereby a potential compensating element in the coating agent line extends from the booth exterior through the booth wall so that the free end of the potential compensating element and therefore the starting point of the grounding interface is located in the booth interior. This is advantageous because then additional fire protection devices are no longer required in the booth exterior because no high voltage potential is then located in this area.

A coating agent line (e.g., hose line) is provided that is suitable for the provision of a coating agent (e.g., paint) in a coating installation, in particular in a painting installation with electrostatic coating agent charging. The coating agent line has, in compliance with the state of the art, a hollow inner space for the provision of the coating agent and a line wall encompassing the hollow inner space of the line. The inventive coating agent line also has an electrically conductive potential compensating element (e.g., an grounding element) in order to electrically connect the coating agent (e.g., paint) in the hollow inner space of the coating agent line with a reference potential (e.g., ground or ground potential), whereby the potential compensating element extends in an axial direction along the coating agent line. Unlike the coating agent line mentioned in the introduction in accordance with EP 1 500 435 A2, the potential compensating element is not, however, integrated in the wall of the coating agent line, but is arranged in the inner space of the line separate from the line wall.

In a preferred embodiment of the invention, the potential compensating element (e.g. grounding element) is extended in a longitudinal direction and connected at one end to the reference potential (e.g. grounding or ground potential) and its opposite free end extends axially into the inner space of the coating agent line. The inventive potential compensating element is therefore preferably in the shape of a lance and can therefore be described as a grounding lance.

In operation, the electrically grounded potential compensating element protrudes with its free end in the direction of flow into the coating agent line so that the coating agent column is electrically grounded upstream in front of the free end of the potential compensating element, whilst the voltage of the coating agent in the coating agent column downstream behind the free end of the potential compensating element increases in an essentially linear manner in relation to the distance to the free end of the potential compensating element. The free end of the potential compensating element therefore forms a starting point of the inventive grounding interface and should therefore remain at a constant position where possible in operation. However, in operation different forces can act on the free end of the potential compensating element, thereby causing a shift of the free end of the potential compensating element. For example, a change in the direction of flow of the coating agent can lead to a corresponding shift in the potential compensating element. However, the inventive potential compensating element may be embodied such that the axial length of the potential compensating element does not depend on the direction of flow of the coating agent of the coating agent line. In addition, the potential compensating element may not be compacted in an axial direction, i.e., the potential compensating element may be essentially rigid in an axial direction.

Furthermore, it should be mentioned that the coating agent line is usually led through a highly mobile painting robot and is therefore subject to dynamic bending in operation, which also applies to the potential compensating element located in the coating agent line. The potential compensating element may therefore be flexible, in particular elastically pliable.

Furthermore, it is to be mentioned that the potential compensating element may be made of an electrically conductive material. One possibility for this is for the potential compensating element to be manufactured solidly from an electrical material. Another possibility is for the potential compensating element to consist of any material which can also be electrically insulating, whereby the potential compensating element then has at least one electrically conductive coating.

Furthermore, the potential compensating element can consist of a solvent-resistant and paint-resistant material because in operation the potential compensating element is exposed to solvents and paints. For example, the potential compensating element can therefore be made of stainless steel (VA steel).

Furthermore, the potential compensating element can extend over only one part of the length of the coating agent line because the coating agent column in the coating agent line is not to be electrically grounded on the high voltage side of the coating agent line. For example, the potential compensating element can extend over a length of more than 50 cm, 1 m, 1.50 m, 2 m and/or over a length of less than 10 m, 9 m, 8 m, 7 m, 6 m, 5 m, 4 m or 3 m. The desired position of the starting point of the grounding interface is decisive for the length of the potential compensating element, i.e. the desired position of the free end of the potential compensating element. The starting point of the grounding interface should therefore be inside the painting booth because only then can the fire protection device located inside the painting booth react to a high voltage related incident. By contrast, if the starting point of the grounding interface is outside the painting booth, additional fire protection devices would be necessary outside the painting booth. In the invention the length of the potential compensating element is therefore such that the free end of the potential compensating element is inside the painting booth.

There are different possibilities with respect to the design of the potential compensating element. In the simplest case the potential compensating element is simply a wire which protrudes into the coating agent line. Another possibility for the potential compensating element is a spiral coil which protrudes into the coating agent line. However, other examples are possible with respect to the realisation of the potential compensating element.

With respect to the coating agent line itself, it should be mentioned that the coating agent line may be flexible, in particular elastically pliable. The coating agent line can therefore be a conventional coating agent hose as known from the state of the art, which does not therefore need to be described in more detail.

The line wall of the coating agent line can be partially or completely an electrically insulating material in order to electrically insulate the partly electrostatically charged coating agent within the line interior relative to the outside.

Furthermore, the line wall of the coating agent line may include at least internally a solvent-resistant and paint-resistant material as is self-evident.

It may already be derived from the above description that the potential compensating element may be an grounding element, where the reference potential is an earth ground potential or reference voltage ground potential. However, corresponding coating agent lines are also possible in which the potential compensating element charges the coating agent within the coating agent line to a different reference potential, for example to a high voltage potential.

A ground-side connecting element can be also provided that is electrically grounded and connected on the ground side with the coating agent line.

Furthermore, a voltage side connecting element may be provided which lies on a high voltage potential and is connected with the high voltage side of the coating agent line.

The connection between the connecting elements and the coating agent line can, for example, be made by a screwed connection as known, for example, from the patent application DE 103 13 063 A1.

It has already been explained above that the coating agent line provides the possibility of arranging the starting point of the grounding interface flexibly within the painting booth.

The painting booth can include electrostatic coating agent charging which charges the coating agent electrostatically by direct charging, which is known from the state of art and which does not therefore need to be described in any more detail.

Furthermore, the painting booth can have a fire protection device which is installed in the inside of the painting booth, in particular with a sprinkler system, a carbon dioxide extinguishing system and/or a fire protection sensor.

The components can be painted in the painting booth by a conventional painting robot with several mobile robot members, whereby the coating agent line is led through the mobile robot members to the application device (e.g. rotary atomiser).

Further, a corresponding manufacturing method is provided for the above described coating agent line. The manufacturing method is initially characterised by the fact that the electrically conductive potential compensating element is used in the hollow inner space of the coating agent line.

In addition, the manufacturing method provides for the potential compensating element to have a length such that the free end of the potential compensating element and therefore the starting point of the grounding interface is inside the painting booth.

Figure 2:
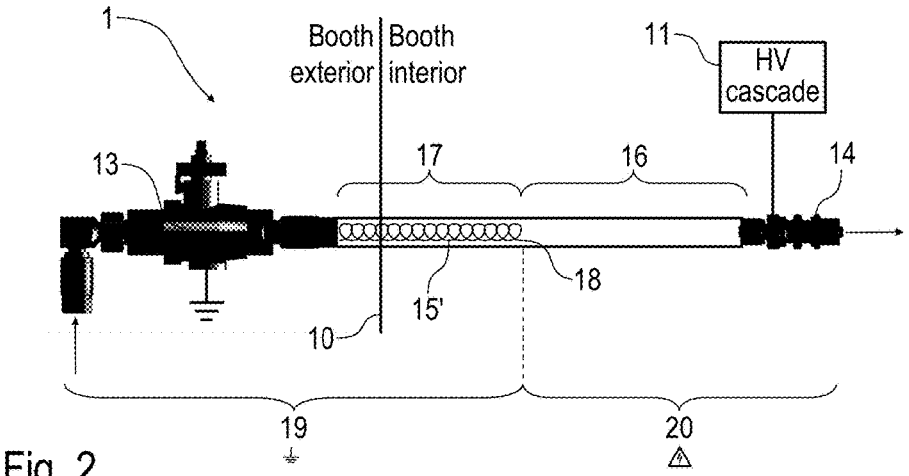
Figure 3:
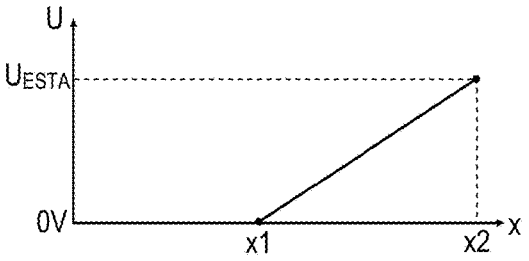
Figure 4:
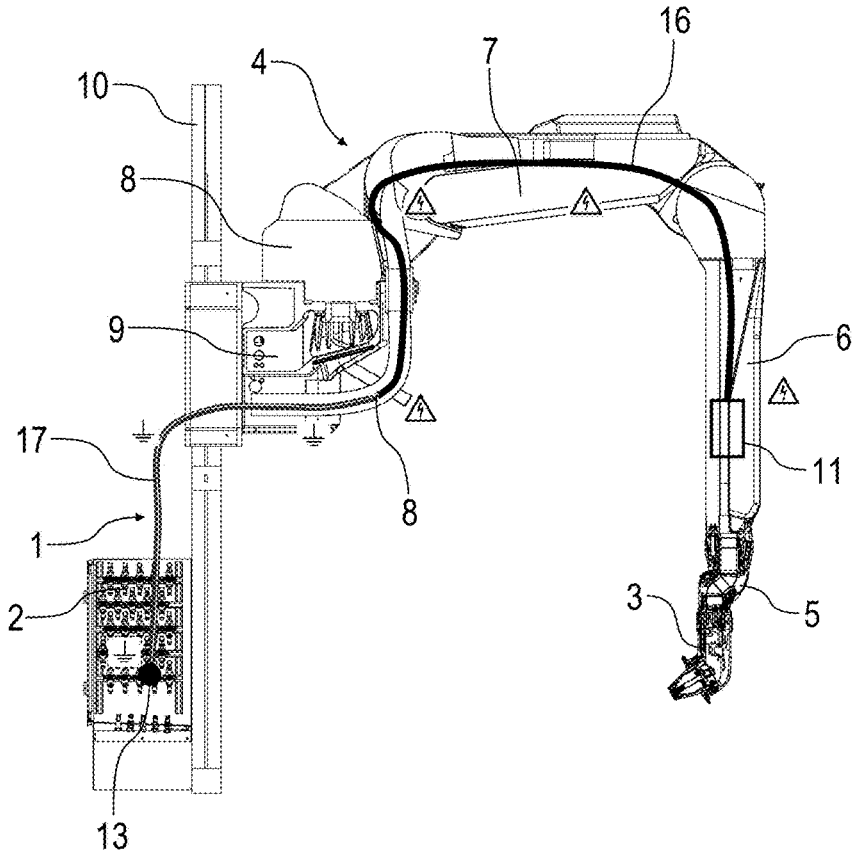

Other advantageous features are explained in greater detail in the following description, including the figures, and/or the claims. The following are shown:

FIG. 1: a diagrammatic presentation of a coating agent line for an exemplary painting booth;

FIG. 2 a modification of the coating agent line in accordance with FIG. 1;

FIG. 3 a potential curve along the coating agent line in accordance with FIGS. 1 and 2; and FIG. 4 a longitudinal sectional view of a painting booth.

FIGS. 1 and 4 show a coating agent line 1 that can be used in a painting installation to paint motor vehicle body components to guide paint to be applied from a paint supply 2 to a rotary atomiser 3.

The rotary atomiser 3 is guided in a conventional manner by a multi-axis painting robot 4 which has one robot hand axis 5, two robot arms 6, 7 and a pivotable robot member 8, whereby the robot member 8 can be moved along a travel rail 9 at right angles to the drawing plane.

The painting robot 4 is located in the painting booth interior whilst the paint supply 2 is arranged in the painting booth exterior. The coating agent line 1 is therefore led through a booth wall 10 of the painting booth, whereby the booth wall 10 separates the booth interior from the booth exterior, which is known from the state of the art.

A high voltage cascade 11 is fitted to the robot arm 6, 7 of the painting robot 4 to electrostatically charge the paint to be applied by way of direct charging, which is known from the state of the art.

The coating agent line 1 essentially consists of a largely conventional hose 12, a ground-side connecting element 13, a voltage-side connecting element 14 and a lance-shaped grounding element 15 which protrudes axially into the hose 12 from the ground-side connecting element 13.

The voltage-side connecting element 14 is connected with the hose 12 by a connecting element, whereby the connecting element may be shaped, for example, in accordance with the patent application DE 103 13 063 A1. It is furthermore to be mentioned that the voltage-side connecting element 14 is connected with the high voltage cascade 11 and is therefore charged to the electrostatic charge voltage.

The ground-side connecting element 13 is similarly connected to the hose 12 by a connecting element. This connecting element can also be shaped in the manner described above. Further, the ground-side connecting element 13 is electrically grounded.

The grounding element 15 consists of an electrically conductive, elastically pliable wire which is connected to the ground-side connecting element 13 at one end and axially protrudes into the hose 12. This divides the hose 12 into a high voltage-side hose section 16 and a ground-side hose section 17, whereby the paint column in the ground-side hose section 17 is electrically grounded upstream before a free end 18 of the grounding element 15, whilst the electrical voltage in the voltage-side hose section 16 increases in a linear manner from the free end 18 of the grounding element 15 in the direction of flow, as shown in FIG. 3. Therefore, the paint column in the hose section 16 has a voltage U=0V at one point x1 in accordance with the free end 18 of the grounding element 15, whilst the electrical voltage U at a point x2 is $U=U_{ESTA}$ in accordance with the voltage-side connecting element. Between the points x1 and x2 the voltage U of the paint column in the hose section 16 therefore increases in a linear manner in the direction of flow.

It is important here that the grounding element 15 has a length such that the free end 18 of the grounding element 15 and therefore the starting point of the grounding interface is located in the booth interior. This is important because a fire protection device is located only inside the booth whilst there is to be no additional fire protection devices exterior of the booth. This is achieved by ensuring through the grounding element 15 that the paint column is electrically grounded outside the painting booth.

All in all, therefore, the coating agent line has an electrically grounded line section 19 and a line section 20 which is on high voltage potential in operation.

FIG. 2 shows a modification of the embodiment in accordance with FIG. 1, whereby this embodiment agrees largely with the above-described embodiment so that reference is made to the above description to avoid repetition, whereby the same reference numbers are used for the corresponding details.

Instead of the wire-shaped grounding element 15, an grounding element 15' in the form of a wire coil has been used.

Both the grounding element 15 in accordance with FIG. 1 and the grounding element 15' in accordance with FIG. 2 have in common that the axial length of the grounding elements 15 and 15' remains essentially constant in operation. This is important so that the free end 18 of the grounding element 15 or 15' in operation remain at a constant location where possible within the painting booth irrespective of the movements of the painting robot 4 and of the direction of flow in the coating agent line 1. At all events, a situation must be prevented in which the free end 18 of the grounding element 15 or 15' moves such that the free end 18 is then outside the painting booth because then a fire protection device would be necessary outside the painting booth.

The invention is not restricted to the above-described preferred embodiments. Rather, a large number of versions and modifications are possible which similarly make use of the inventive idea and which therefore fall within the protective area. In addition, the invention also claims protection for the features and the subject matter of the subclaims irrespective of the claims referred to.

The invention claimed is:

1. A painting booth comprising: a booth wall that separates a booth interior from a booth exterior; a painting robot located in the booth interior and including a voltage cascade and a voltage connecting element to directly charge a coating agent before the coating agent is atomized; wherein said painting robot is a multi axis painting robot;

a paint supply located in the paint booth exterior and having a ground side connecting element located in the paint booth exterior;

a coating agent line connected to the paint supply and the coating agent line is led through the painting robot, the coating agent line includes an inner space for conveying the coating agent and a line wall which encompasses the inner space; wherein the coating agent line runs from the booth exterior through the booth wall into the booth interior, the coating agent line directly connected to the voltage connecting element, said inner space is hollow, further wherein:

the coating agent line includes potential compensating element which is electrically conductive, located entirely in the hollow inner space, and connected to the ground side connecting element at one end and the potential compensating element at an opposite end having a free end; said free end extending axially into the inner space of the coating agent line providing a grounding interface and dividing the coating agent line into a voltage-side section and a around-side section, the potential compensating element extends in an axial direction along the coating agent line, the potential compensating element in the inner space is arranged separately from the line wall, and the potential compensating element extends from the booth exterior through the booth wall so that the free end of the potential compensating element is located in the booth interior and upstream from the voltage connecting element.

2. The painting booth of claim 1, wherein the potential compensating element has an axial length that is substantially constant irrespective of the direction of flow of the coating agent in the coating agent line.

3. The painting booth of claim 1, wherein the potential compensating element is not compactable in the axial direction.

4. The painting booth of claim 1, wherein the potential compensating element is flexible.

5. The painting booth of claim 1, wherein the potential compensating element is made of at least one of (a) an electrically conductive material, and (b) a solvent-resistant and paint-resistant material.

6. The painting booth of claim 1, wherein the potential compensating element extends only over a part of the length of the coating agent line.

7. The painting booth of claim 6, wherein the potential compensating element extends over a length of more than 50 centimeters.

8. The painting booth of claim 6, wherein the potential compensating element is extended lengthwise.

9. The painting booth of claim 1, wherein the potential compensating element is one of a spiral coil and a wire.

10. The painting booth of claim 1, wherein the coating agent line is a flexible, elastically pliable hose.

11. The painting booth of claim 1, wherein the line wall of the coating agent line is composed at least partially of an electrically insulating material and electrically insulates the coating agent in the inner space.

12. The painting booth of claim 1, wherein the line wall of the coating agent line includes a solvent-resistant and paint-resistant material at least on an interior of the coating agent line.

13. The painting booth of claim 1, further comprising a fire protection device that is installed in the painting booth interior.

14. The painting booth of claim 13, wherein the fire protection device includes at least one of a sprinkler system, a carbon dioxide extinguishing system, and a fire protection sensor.

* * * * *